US006119894A

United States Patent [19]

Hassan

[11] Patent Number: 6,119,894

[45] Date of Patent: Sep. 19, 2000

[54] PILL DISPENSER WITH PIVOTING CONICAL TRANSFEROR

[76] Inventor: Issa Hassan, 59 Spruce Meadows, Kanata, Ontario, Canada, K2M 2K4

[21] Appl. No.: 09/030,864

[22] Filed: Feb. 26, 1998

[51] Int. Cl.[7] ..... G07F 11/06

[52] U.S. Cl. ..... 221/288; 221/90; 222/534; 222/536

[58] Field of Search ..... 221/288, 90; 222/534, 222/536

[56] References Cited

U.S. PATENT DOCUMENTS

| | | | |
|---|---|---|---|
| 2,838,204 | 6/1958 | Snyder . | |
| 3,089,626 | 5/1963 | Kubiliunas | 222/536 |
| 3,189,222 | 6/1965 | Smalley | 221/288 X |
| 3,257,029 | 6/1966 | Smalley . | |
| 3,480,182 | 11/1969 | Rigor | 221/288 |
| 3,622,041 | 11/1971 | Borsum et al. | 221/288 X |
| 3,637,109 | 1/1972 | Stifter | 221/288 X |
| 3,991,908 | 11/1976 | Thomas et al. . | |
| 4,282,991 | 8/1981 | Hazard | 222/536 X |
| 4,530,447 | 7/1985 | Greenspan | 221/288 |
| 4,723,690 | 2/1988 | Vom Holfe | 221/288 X |
| 5,484,089 | 1/1996 | Picerno | 222/534 |
| 5,524,799 | 6/1996 | Skillin | 222/534 |

FOREIGN PATENT DOCUMENTS

| | | |
|---|---|---|
| 002677615 | 12/1992 | France . |
| 0863472 | 9/1981 | U.S.S.R. . |

*Primary Examiner*—Christopher P. Ellis
*Assistant Examiner*—Patrick Mackey
*Attorney, Agent, or Firm*—Freedman & Associates

[57] ABSTRACT

A pill dispensing cap assembly to dispense a pill or the like received from a pill container engaged therebelow. The assembly comprises two components, namely a pill transferor to dispense one pill and a base. A cavity in said pill transferor is provided, said cavity having an exposed end and being shaped to form a conical surface therein. The conical shape of the pill transferor cavity, advantageously, provides for the engagement and dispensing of one pill from the pill container regardless of the shape and size of the pills. The base is adapted to pivotably receive said pill transferor, the base having an opening for pill communication between the pill container and the cavity, and a bottom portion of the base adapted to engage the pill container in a child proof manner. In addition, there are two opposed pins extending outwardly on lateral surfaces of the pill transferor to engage the base. A cam on a bottom portion of said pill transferor engages said opening. The base has pivoting spring means to engage the pins and cooperate with the cam and the pins to provide a switchable pill dispensing and pill receiving position for the pill transferor.

9 Claims, 8 Drawing Sheets

PILL DISPENSER WITH PIVOTING CONICAL TRANSFEROR

BACKGROUND OF THE INVENTION

1. Field of the Invention

This invention relates to pill dispensers. In particular, the invention described herein relates to a pill dispensing cap assembly mounted onto the neck of a pill container to dispense one pill at a time regardless of shape and size of the pills.

2. Description of the Prior Art

In this field of art there have been numerous attempts to provide a simple pill dispenser means to dispense one pill at a time from a container holding loosely stored pills.

For example, U.S. Pat. No. 3,991,908 to Thomas et al. teaches a pill dispensing cap assembly device adapted for mounting on the neck of a pill container. The cap assembly includes a plurality of different components, including a rotor member to pick up a pill from the container and transfer it to a dispensing end. The design of the cap was directed towards nitroglycerin tablets and others of similar shape and size. The design would have to be adapted for operation with pills of different shapes and sizes.

U.S. Pat. No. 3,257,029 to Smalley teaches a pill dispenser having a two piece design adapted to engage the neck of a pill container. The user is required to rotate one piece of the design with respect to the other so as to effect dispensing of a pill by a series of successive rotative movements while the container is held upside down.

U.S. Pat. No. 2,838,204 to Snyder teaches a pill dispenser having a single piece design. The dispensing portion is a flat-walled tube of resilient material having a longitudinal slit through which individual pills are manually manipulated therethrough.

While the prior art teaches dispensing of pills one at a time, there are a number of drawbacks to the designs disclosed. Some prior art teaches rotative manipulation of a component of a pill dispenser while other prior art requires considerable amount of manual manipulation by the user to extract a single pill. Many users, some of which having acute arthritic restrictions, are interested in a pill dispenser not having a rotative requirement and a limited amount of intricate manual manipulation. Therefore, it is desired to have a pill dispenser to dispense one pill at a time with limited manual manipulation and rotation of the user's hands. In addition, some of the prior art is restricted in the range of pill shapes and sizes that may be used in any one dispenser. What is desired is a pill dispenser that will work with a wide variety of pill shapes and sizes. Further, the pill container in some instances of the prior art required modification to mount a pill dispensing assembly. It is desired that the pill dispensing assembly be readily mountable on typical pill containers provided at most pharmacies and other off the shelf containers. Furthermore, it is desired for a pill dispenser to have a limited number of components so as to reduce manufacturing and assembly costs of the dispenser.

SUMMARY OF THE INVENTION

It an object of the invention to overcome some of the drawbacks of the prior art.

Another object of the invention is to provide a simple manufacturing design.

Another object of the invention is to provide a means to dispense one pill at a time without intricate manual or rotative manipulation by the user.

Another object of the invention is to provide a pill dispensing cap assembly that is readily mountable on typical pill containers provided at most pharmacies.

According to the invention there is provided a pill dispensing cap assembly to dispense a pill or the like received from a pill container engaged therebelow, the assembly comprising two components, namely a pill transferor to dispense one pill, and a base. A cavity in the pill transferor is provided, the cavity having an exposed end and being shaped to form a conical surface therein. The conical shape of the pill transferor cavity, advantageously, provides for the engagement and dispensing of one pill from the pill container regardless of the shape and size of the pills. The base is adapted to pivotably receive the pill transferor, the base having an opening for pill communication between the pill container and the cavity, and a bottom portion of the base adapted to engage the pill container in a child proof manner. In addition, there are two opposed pins extending outwardly on lateral surfaces of the pill transferor to engage the base. A cam on a bottom portion of the pill transferor engages the opening. Pivoting spring means engage the pins and cooperate with the cam and the pins to provide a switchable pill dispensing and pill receiving position for the pill transferor.

For a more complete understanding of the pill dispensing system and components thereof, reference is made to the following detailed description and accompanying drawings in which the presently preferred embodiments of the invention are shown by way of example. As the invention may be embodied in many forms without departing from the spirit of essential characteristics thereof, it is expressly understood that the drawings are for purposes of illustration and description only, and are not intended as a definition of the limits of the invention. Throughout the description, like reference numbers refer to the same component throughout the several views.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

A preferred embodiment of the invention is shown in FIGS. 1–16. The pill dispensing cap assembly 1 is mountable on the open neck of a pill container 4. The dispensing cap assembly, in the preferred embodiment, is mounted to the container by a child proof screw and thread combination 6 along the engaging peripheral edges of the bottom portion of the dispensing cap assembly and the open neck portion of the container. In this preferred embodiment, the container is replenished with additional pills by unscrewing the pill dispensing cap assembly from the container and pouring pills therein. In another embodiment of the invention, the dispensing cap assembly may be integrally molded with the container (not shown). In that alternative embodiment, the container may be replenished with pills by a flip-top connection that separates the dispensing cap assembly from the container.

Figure 1:
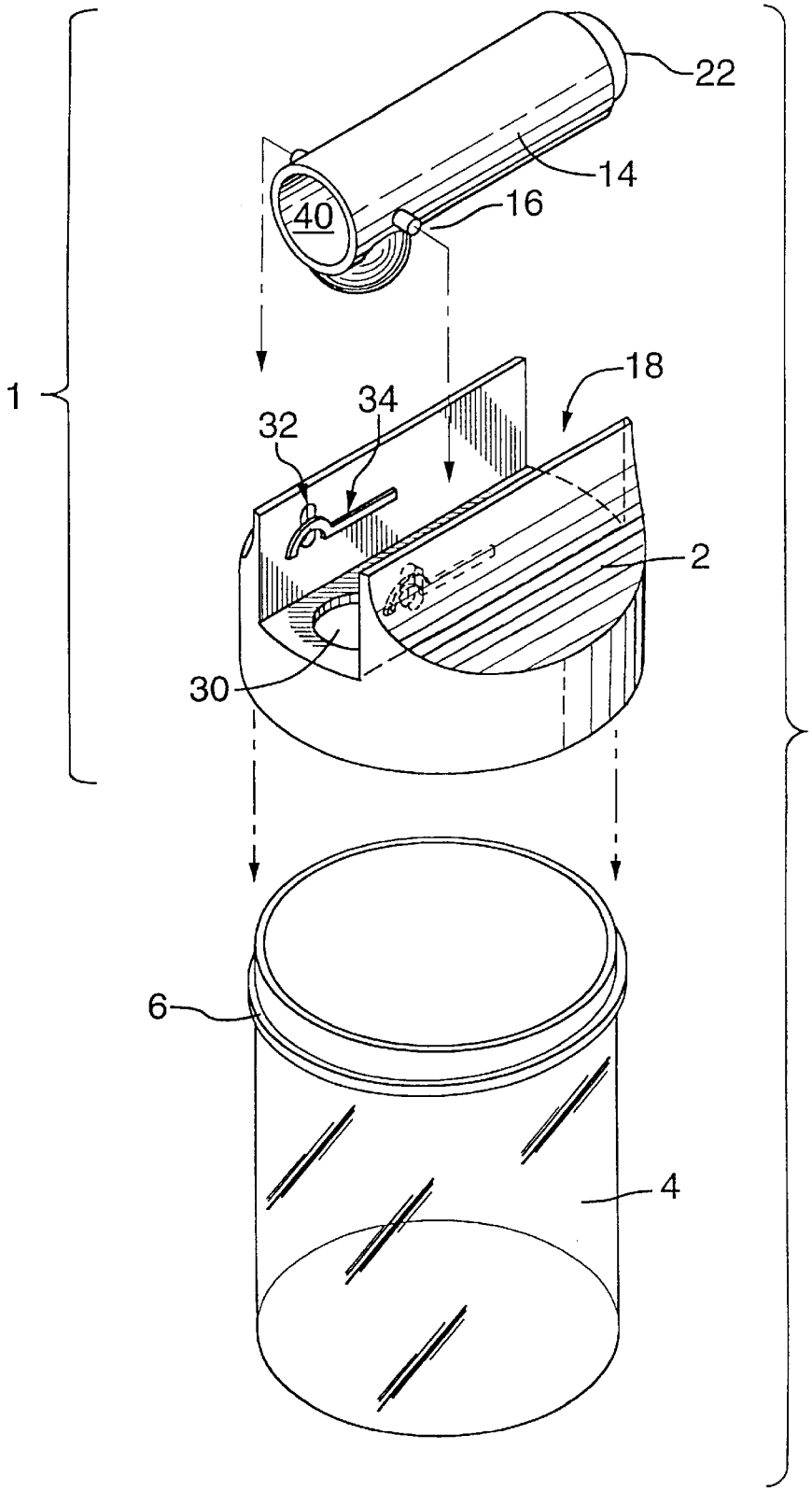
FIG. 1 is an exploded perspective view of a pill dispensing cap assembly and a container for mounting the cap assembly thereon.
Figure 2:
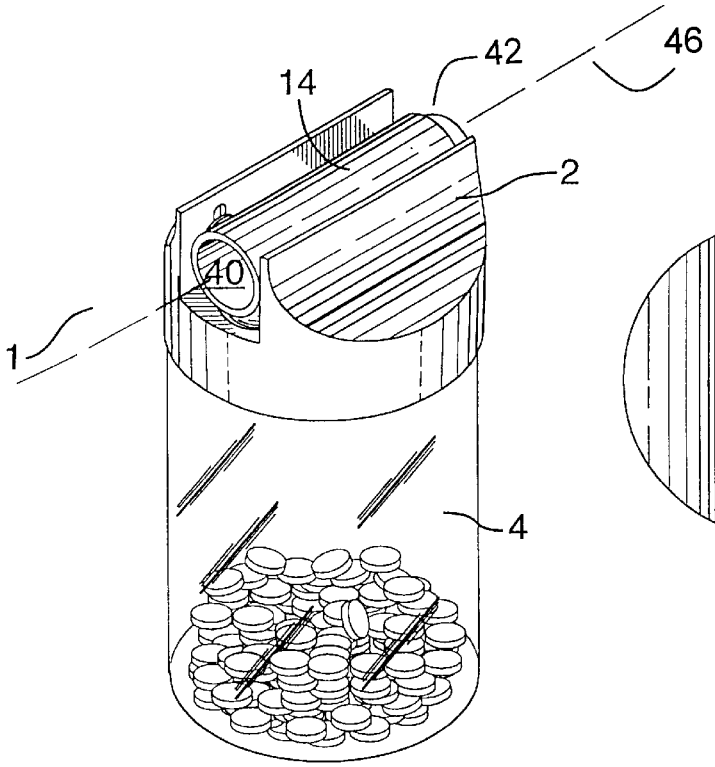
FIG. 2 is a front perspective view of the pill dispenser.

The dispensing cap assembly 1, as shown in FIG. 1, comprises of a two component design, namely a pivotable pill transferor 14 and a base 2 to pivotably receive the pill transferor thereon.

Figure 15:
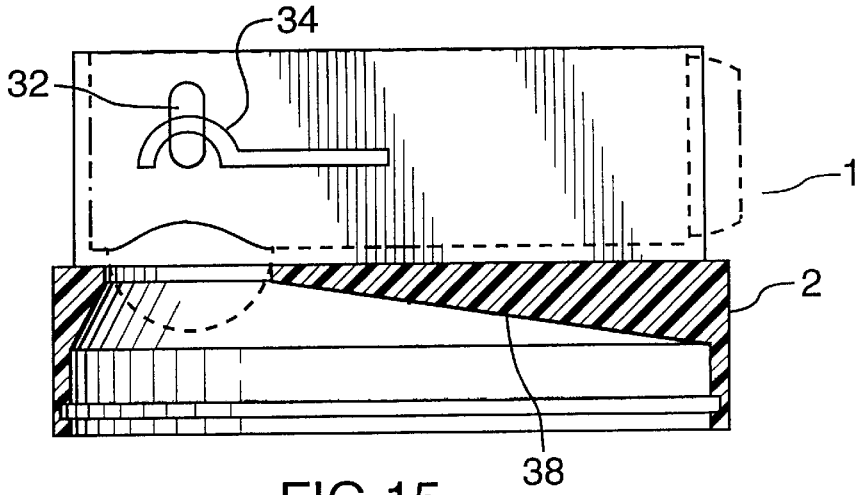
FIG. 15 is the side view of FIG. 14 showing the pill transferor in ghost.
Figure 14:
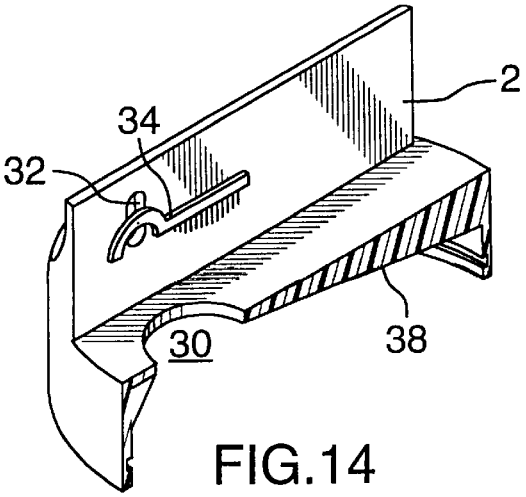
FIG. 14 is a perspective sectional view of the pill dispenser lid.
Figure 16:
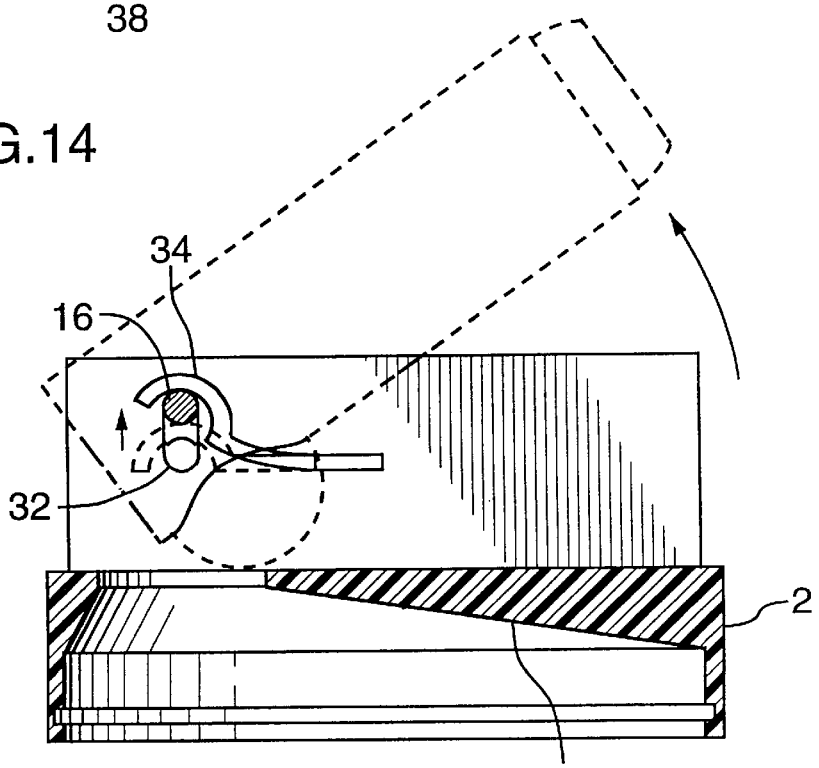
FIG. 16 is the view of FIG. 14 showing the operation of the spring and pivot in operation.

The base 2 has a recessed area 18 on the top end of the base portion. The recessed area has two oppositely facing sidewalls and a horizontal surface having a hole 30 extending through the base. As shown in FIGS. 14–16, on each sidewall there is provided a vertical slot 32 of sufficient width and depth to receive pin 16. Integrally molded on the face of each sidewall is a downwardly biasing spring element 34 that extends past the slot 32, preferably, in a downward hook fashion. The distance between the pin engaging surfaces of the hook and slot is of sufficient space to receive and secure pin 16 in the constant communication with the slot. Other downwardly biasing spring elements may be provided to achieve the same results and still fall within the scope of the invention. For instance, the spring element may be linearly shaped throughout its length instead of being hook shaped at the point of contact with the pin.

In the preferred embodiment, the pill transferor 14 has a cylindrical exterior shape. Other exterior shapes for the pill transferor may be utilized such as a cone and still fall within the scope of the invention. The pill transferor is pivotally connected to the base 2 with the slots 32 by two axially aligned outwardly extending pins 16. Each pin is integrally molded on a lateral surface of the pill transferor 14. The pivoting action of the pins are further expanded to include limited vertical movement provided by slots 32. The integrally molded spring elements 34 naturally urge the pins 16 in a downward vertical direction. The combined pivoting-vertical action of the pins allows the pill transferor to be switchable between a stable pill receiving and pill dispensing position.

Figure 3:
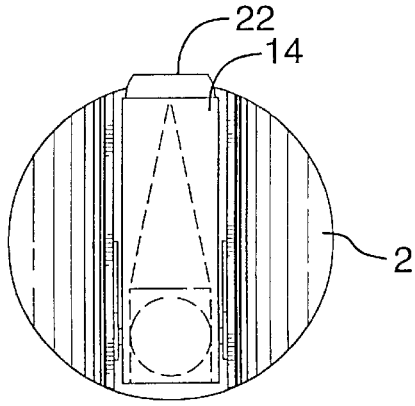
FIG. 3 is a top view of FIG. 2.
Figure 4:
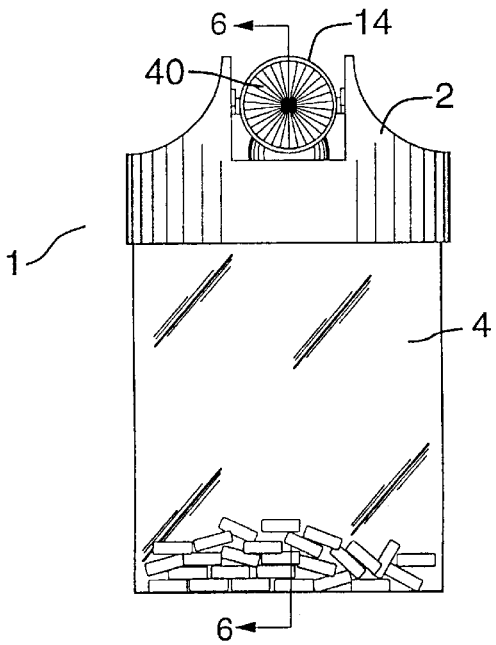
FIG. 4 is a front view of FIG. 2.
Figure 5:
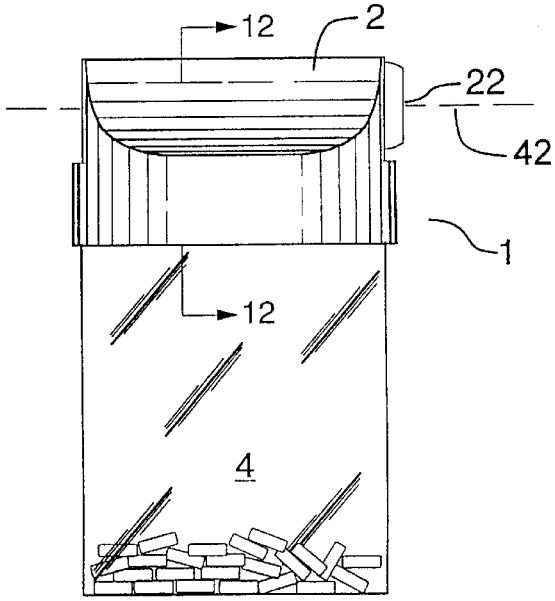
FIG. 5 is a right side view of FIG. 2.

The pill transferor 14 is shown in FIGS. 2–6 in a pill dispensing/rest position. In this position 42 (the axis of the conical cavity in this dispensing position is represented by dotted line 46), the pill transferor rests substantially horizontally in the recessed area 18. As shown in FIG. 3, at one end of the pill transferor is a lifting end having a finger debit 22.

Figure 7:
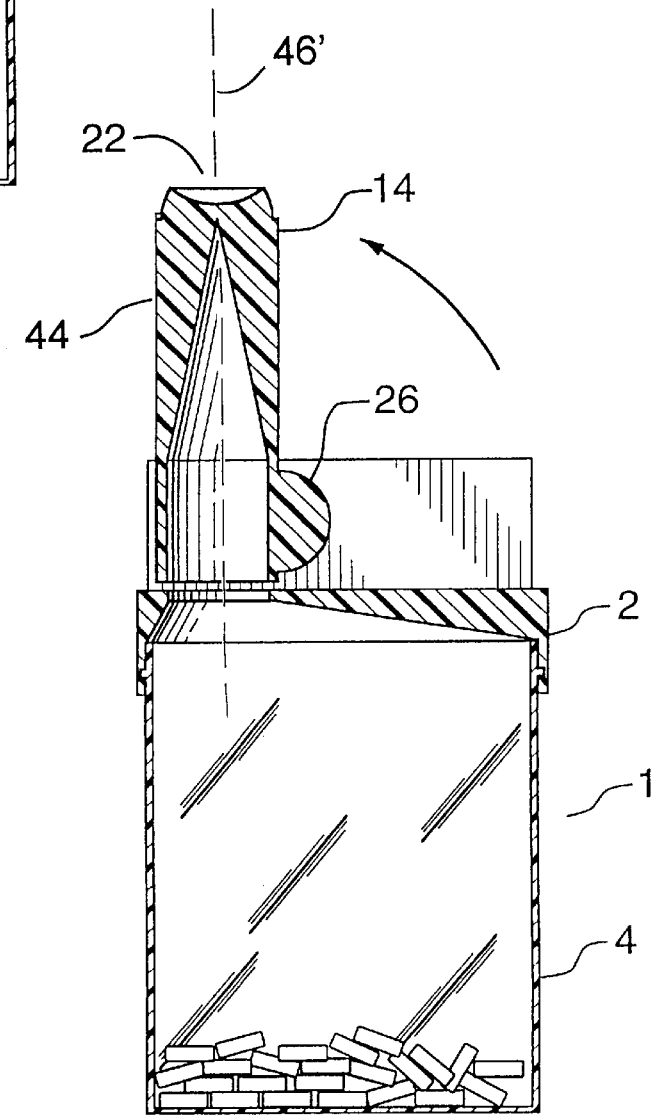
FIG. 7 is the view of FIG. 4 with the pill transferor in an upright position.
Figure 8:
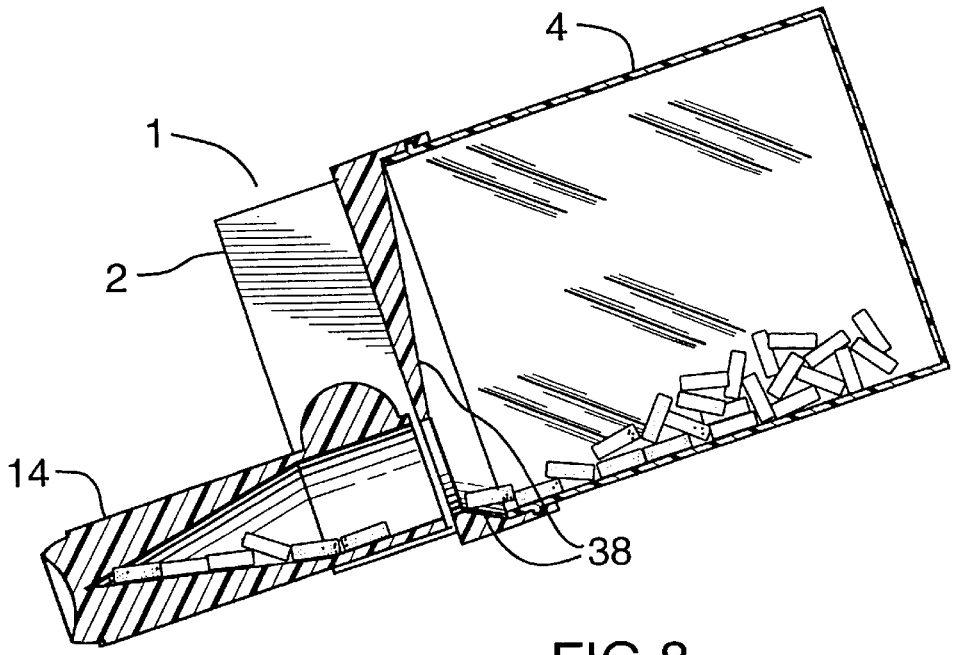
FIG. 8 is the view of FIG. 4 with the pill dispenser tilted.
Figure 17:
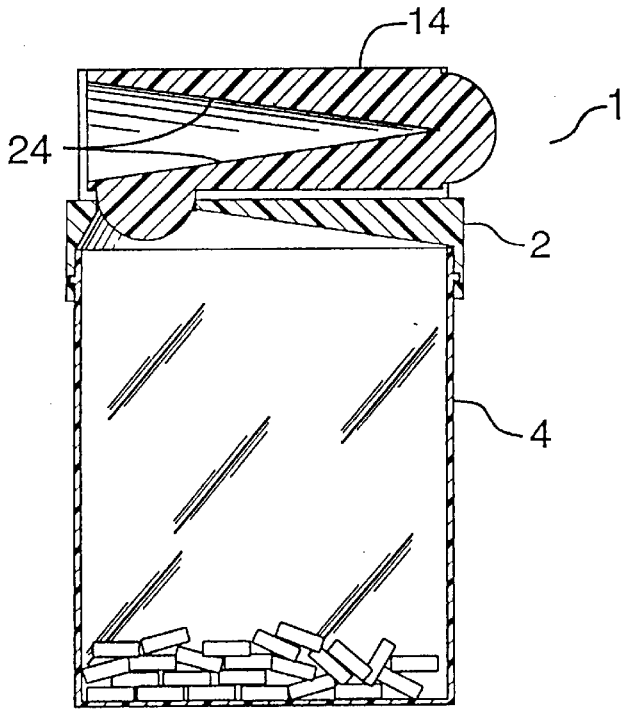
FIG. 17 is the view of FIG. 6 showing an alternative embodiment of the conical cavity in the pill transferor; and, FIG. 18 is the view of FIG. 6 showing an alternative embodiment of the finger debit.
Figure 18:
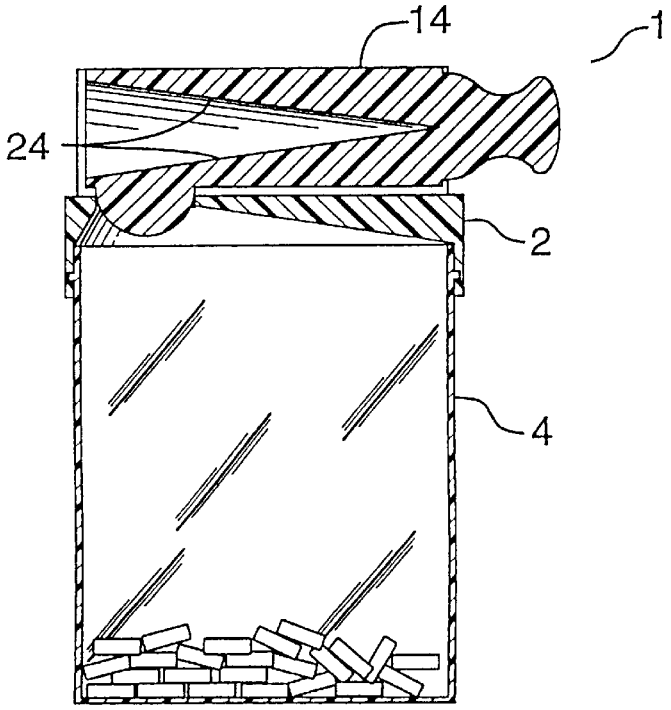

The pill transferor 14 has a cavity 40 forming a conical surface 24. The cavity has an open end with which pills are received therethrough when the pill transferor is in a pill receiving position 44 (the axis of the conical cavity in receiving position is represented by dotted line 46 and with which pills are dispensed therefrom when the pill transferor is in a pill dispensing/resting position. In the preferred embodiment, a cylindrical portion commences from the edge of the cavity opening and then merges with a conical surface 24 (as shown in FIG. 7). The conical surface is an essential feature of the invention. The conical surface advantageously allows for only one pill of any shape and size to be engaged and dispensed at a time. In another embodiment of the cavity, the conical surface commences from the edge of the cavity opening, as shown in FIG. 17, without a cylindrical surface. The pill transferor is preferably translucent so as to allow the user to have visual contact with the pill inside the cavity. Various angles and depths of the conical surface may be used and still achieve the desired results. The depth of the conical surface should be sufficiently deep so as to allow at least one or more of the pills to completely pile therewithin. The angle of the conical surface should be such that the region generally near the convergence of the conical surface engages portions of the lower-most pill piled within the cavity 40, as shown in FIG. 8. The conical surface may be textured so as to assist the retaining of the pill.

When the pill transferor is in the dispensing position, the semi-spherical cam 26 interfaces with hole 30, as shown in FIGS. 2–6, thereby locking the pill transferor in a horizontal resting position. Once the hole is closed by the cam 26, pills in the container cannot exit through the hole 30. As shown in FIG. 8, a tapered surface 38 is provided on the bottom side of the base. This is to encourage the loosely stored pills resting on the tapered surface, as result of the container being tilted from its upright position, to slide towards the hole 30.

Figure 6:
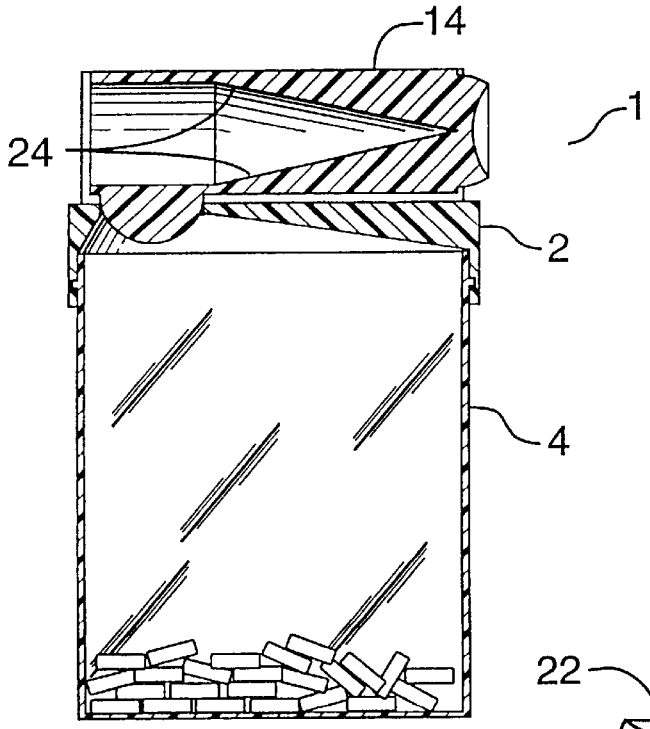
FIG. 6 is a sectional view along line 6—6 of FIG. 4.
Figure 9:
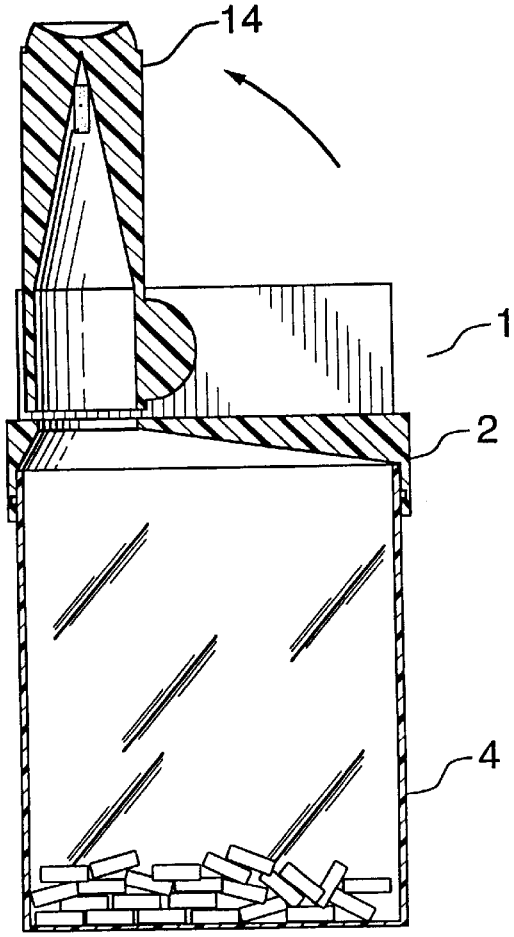
FIG. 9 is the view of FIG. 4 with the pill dispenser back to its upright position and having a pill engaged in the conical net.
Figure 10:
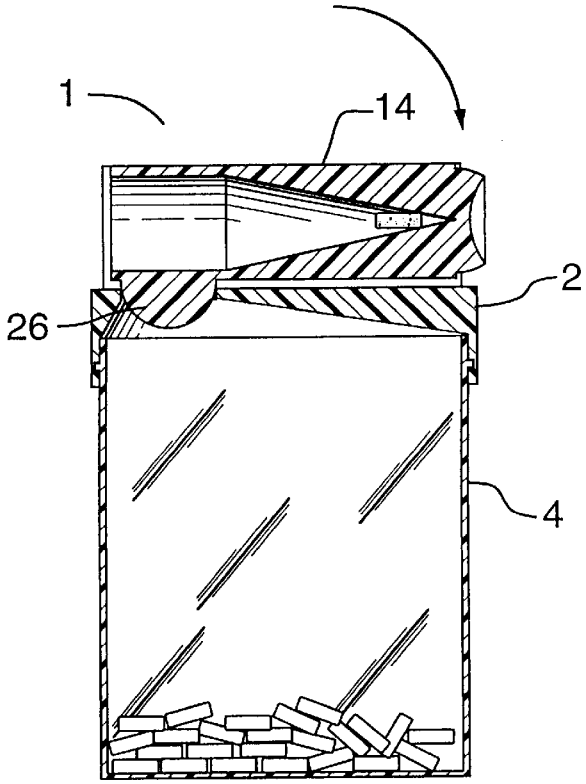
FIG. 10 is the view of FIG. 4 with the pill transferor returned to its rest position.
Figure 11:
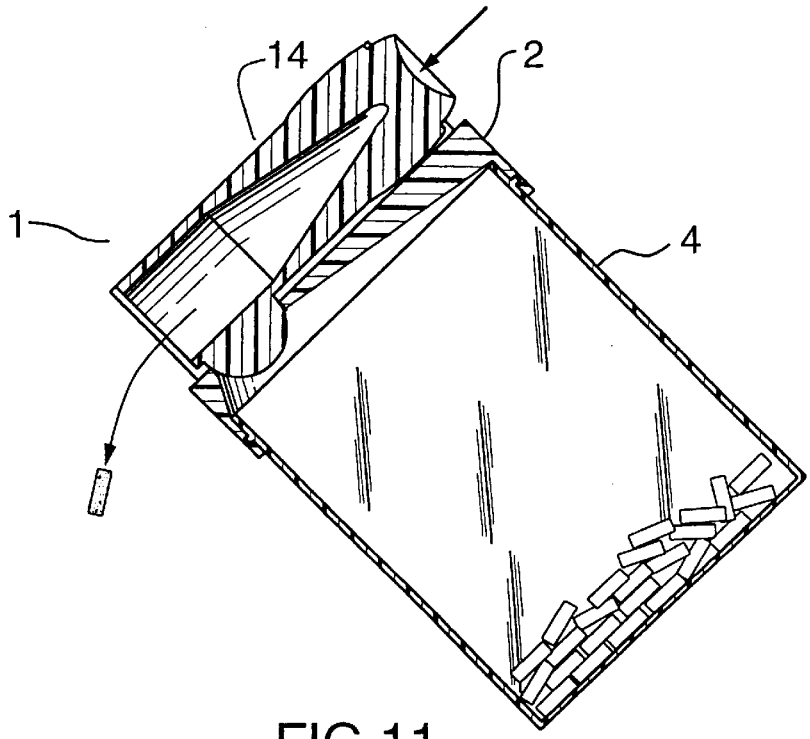
FIG. 11 is the view of FIG. 4 with the dispenser tilted and a finger initiating the ejection of the engaged pill.
Figure 12:
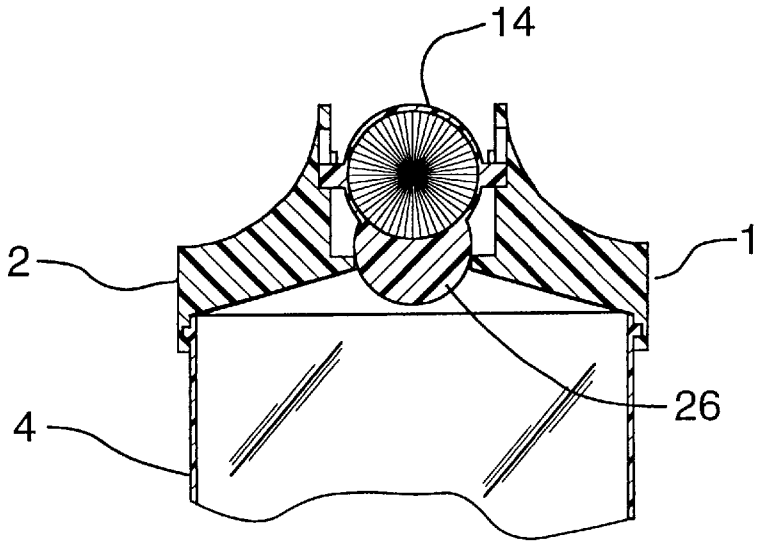
FIG. 12 is a sectional view along line 12—12 of FIG. 5.
Figure 13:
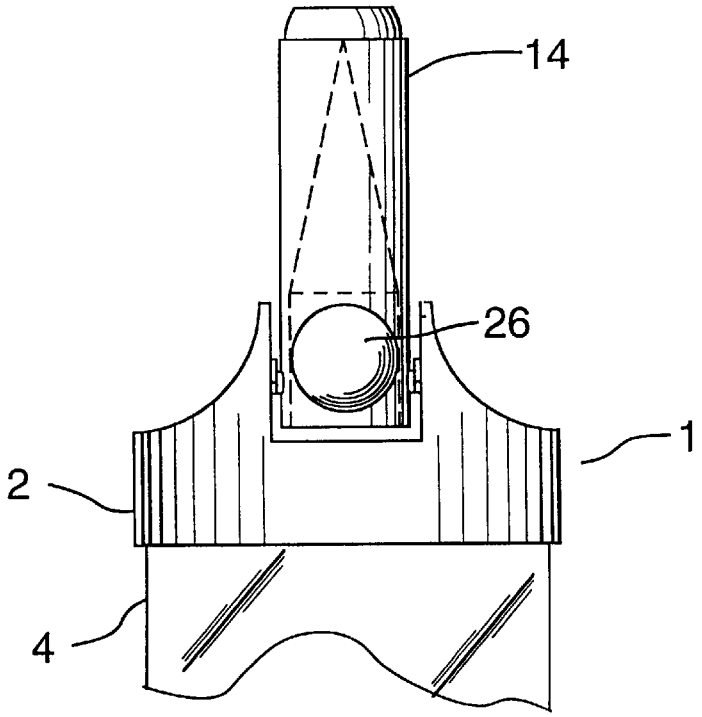
FIG. 13 is a rear view of the pill dispenser with the pill transferor in an upright position.

The sequence of steps to dispense one pill from the container through the pill dispensing cap assembly is illustrated in FIGS. 6–11. To operate the device the user switches the pill transferor from the horizontal dispensing position (resting position), as shown in FIG. 6, to a vertical receiving position, as shown in FIG. 7, by pivoting the pill transferor upwards with the finger debit 22. The pill transferor is then locked in the vertical position by the biasing spring elements 34 for saftey purposes. In this position the hole 30 communicates with the cavity opening of the pill transferor. The user then tilts the container so as to encourage pills therein to slide into the direction of the hole 30. Once at least one pill enters the inner most portion of the cavity 40 (as shown in FIG. 8), the container may be returned to an upright position (as shown in FIG. 9). At this point only one pill should remain in the cavity. The conical surface 24 advantageously allows for only one pill to be retained in the cavity while the other pills that may have slid into the cavity to simply now fall out of the cavity and return to the container 2 through the hole 30. The pill transferor is then returned to its original dispensing/resting position (as shown in FIG. 10). The finger debit 22 is then pushed inwards, as shown in FIG. 11, to eject the pill retained in the conical cavity. By the user depressing/tapping the finger debit the pressure and/or the contact of the conical surface on/with the retained pill in the conical cavity is reduced/removed. FIG. 11 illustrates how the finger debit end of the pill transferor, under presssure, slightly deforms outwardly. As a result, the retained pill freely slips away from the captured engagement thereof with the conical surface 24. In addition to the advantageous shape of the conical surface, the pressure due to the weight of other pills on top of the bottommost pill and/or possibly the textured surface allows for only one pill to remain in the cavity when the container is returned to the upright position. The pill transferor has had best results in engaging only pill therein with pill transferors made of bendable plastic or rubber. Other materials may also be suitable.

The conical shaped portion of the cavity is the element that isolates and captures one object at a time regardless of the shape and size of that object and is considered the essence of the present invention.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed is:

1. A pill dispensing cap assembly to dispense a pill received from a pill container engaged therebelow, said assembly comprising:

a base securable across an otherwise open top of said pill container, having an opening therethrough communicating with said pill container;

a pill transferor pivotally mounted on said base for pivoting between a pill-receiving position and a pill-dispensing position, said pill transferor having a conical cavity with an open first end and a conical shape closed second end, said open first end positioned to communicate with said opening in said base when said pill transferor is in said pill-receiving position, to receive pills from said pill container, said open first end being exposed when said pill transferor is in said pill dispensing position, a portion of said pill transferor blocking said opening in said base when said pill transferor is in said pill-dispensing position; and, two co-axially aligned pins extending laterally outwardly from said pill transferor to engage said base.

2. A pill dispensing cap assembly as recited in claim 1, further comprising a cam on a bottom portion of said pill transferor to engage said opening.

3. A pill dispensing cap assembly as recited in claim 2, further comprising pivoting spring means for engaging said pins and cooperating with said cam.

4. A pill dispensing cap assembly as recited in claim 3, wherein an axis of said conical cavity is perpendicular with the axis of said pins.

5. A pill dispensing cap assembly as recited in claim 4, wherein said pill transferor having a finger debit on the opposite end thereof.

6. A pill dispensing cap assembly as recited in claim 5, wherein said opening is axially aligned to said exposed end of said cavity to receive pills from said pill container when said pill transferor is in a receiving position.

7. A pill dispensing cap assembly as recited in claim 6, wherein said base having a recessed area on a top portion of said base to receive said pill transferor in a dispensing position.

8. A pill dispensing cap assembly as recited in claim 7, wherein said pivoting-spring means comprises:

two recessed slots on sidewalls of said recess to receive said pins, said slots being vertically disposed; and two springs integrally adapted on said sidewalls to downwardly bias the vertical movement of said pins in said slots.

9. A device as recited in claim 8, further comprises said pill transferor having a cylindrical shape and being translucent so as to allow the user to have sight of pills in said cavity.

* * * * *